US005703572A

United States Patent [19]

Miyashita et al.

[11] Patent Number: 5,703,572

[45] Date of Patent: Dec. 30, 1997

[54] INFORMING DEVICE FOR A RADIO RECEIVER

[75] Inventors: Yukio Miyashita, Tokyo; Toshiro Nishiyama, Shizuoka, both of Japan

[73] Assignee: NEC Corporation, Tokyo, Japan

[21] Appl. No.: 761,012

[22] Filed: Dec. 5, 1996

Related U.S. Application Data

[63] Continuation of Ser. No. 274,434, Jul. 13, 1994, abandoned.

[30] Foreign Application Priority Data

Jul. 14, 1993 [JP] Japan ..... 5-173524

[51] Int. Cl.[6] ..... G08B 5/22

[52] U.S. Cl. ..... 340/825.44; 340/825.45; 340/309.15; 455/38.3

[58] Field of Search ..... 340/825.44, 825.45, 340/825.46, 309.4, 309.15; 455/343, 38.3, 228; 379/373, 375, 376

[56] References Cited

U.S. PATENT DOCUMENTS

| | | | |
|---|---|---|---|
| 3,806,665 | 4/1974 | Goldberg | 379/373 |
| 4,701,759 | 10/1987 | Nadir et al. | 340/825.44 |
| 4,755,816 | 7/1988 | De Luca | 455/38.3 |
| 4,872,005 | 10/1989 | De Luca et al. | 340/825.44 |
| 5,012,219 | 4/1991 | Henry | 340/311.1 |
| 5,153,580 | 10/1992 | Pollack | 340/309.15 |
| 5,272,475 | 12/1993 | Eaton et al. | 455/38.3 |
| 5,469,133 | 11/1995 | Hensler et al. | 340/825.44 |

FOREIGN PATENT DOCUMENTS

| | | | |
|---|---|---|---|
| 1-160122 | 6/1989 | Japan . | |
| 9208214 | 5/1992 | WIPO | 340/825.44 |

OTHER PUBLICATIONS

Motorola Brochure, 1990, 6 pages.

*Primary Examiner*—Michael Horabik
*Assistant Examiner*—Edward Merz
*Attorney, Agent, or Firm*—Sughrue,Mion,Zinn,Macpeak & Seas, PLLC

[57] ABSTRACT

When a switch for manually terminating an informing operation of a call informing device is not depressed during an informing operation, the informing operation is automatically halted after a first set time of a first timer. After a second period of time T, determined by a second timer, elapses from the start of the informing operation, the informing operation is repeated for the first set time of the first timer. After the second period of time T elapses from the start of the second informing operation, the informing operation is repeated. The informing operations are performed, halted and repeated until the user terminates the operation of the call informing device. During the period of time from the first informing operation to the depression of the switch, a counter and a timer setting circuit increment the second period of time (halt interval) to N.T corresponding to the increase in the number N times of the informing operation. Accordingly, the user of the receiver can be made aware of a call as quickly as possible by carrying out the informing operations with short halt intervals immediately after the call is received. On the other hand, if the switch is not depressed even after many informing operations, the life of the battery is prolonged by increasing the halt interval between informing operations in accordance with the number of informing operations performed.

13 Claims, 6 Drawing Sheets

SIGNAL 100

R

Q1

Q2

Q3 d

D

INFORMING DEVICE FOR A RADIO RECEIVER

This is a Continuation application of U.S. appln. Ser. No. 08/274,434, filed of Jul. 13, 1994, now abandoned.

BACKGROUND OF THE INVENTION

1. Field of the Invention

The present invention relates to a radio receiver and, more particularly, to a receiver having a call informing device which reminds the user that a call signal has been received.

1. Description of the Related Art

In a radio receiver, for example, a selective calling receiver including a pager, informing a user of a call by outputting an audible alerting sound from a speaker or the like takes place in order to let the user know of a call made to the receiver. However, if the receiver continues the informing operation while the user remains unaware of the incoming call, the battery life of the receiver is diminished, and there may occur a case in which the battery life is expired while the user leaves the receiver at home, resulting in a situation where it is impossible to convey a message to the user. For this reason, in the receiver, the informing operation is automatically stopped after passage of certain period of time from the start of the informing operation, and a re-informing operation is repeated as described below.

When a switch for manually stopping the informing operation is not depressed by the user, after passage of a certain period of time, preferably 8 to 20 seconds, from the start of the informing operation, the receiver automatically stops the informing operation. After passage of an additional period of time, preferably 2 to 15 minutes, from the start of the informing operation, the receiver starts alerting again.

The above-described receiver suffers from a disadvantage where there is a marked reduction in the battery life when the owner goes away leaving the pager at home, and a re-informing interval is short, because the re-informing interval following the automatic termination of the informing operation is set to be constant.

A paging receiver is a device which is used to get in contact with the user immediately. For this reason, it is desirable to provide a re-informing operation in such a manner as to give about 20 seconds of alerting time in a one minute time interval, for example, by minimizing the time before initiating the re-informing operation. However, this leads to about 1 hour of alerting in 3 hours, which drastically reduces the battery life of the receiver. On the other hand, if the re-informing interval of 20 seconds is extended to 30 minutes, the re-informing operation fails to sufficiently alert the user in the case of an emergency. Accordingly, when a reduction of the re-informing interval is desired in the informing system for the prior art pager, it is necessary to compromise the life of the battery.

Another receiver is disclosed in, for example, Japanese Patent Publication Laid-Open No. 160122/1989 (JP-A-01-160122) or U.S. Pat. No. 4,701,759. The receiver generates a first alerting pattern having a long alerting duration and a short alerting halt duration in the initial period of the informing operation. If the switch for manually terminating the informing operation is not depressed within a predetermined time period, the receiver automatically terminates the informing operation. After another predetermined time period has elapsed, the receiver generates a second alerting pattern with a short alerting duration and a long alerting halt duration. Thus, the receiver continues the informing operation by suppressing the power consumption of the informing operation.

In this receiver, it is necessary to shorten the alerting duration of the second alerting pattern. However, a short alerting duration tends to be missed by the user.

Furthermore, the receiver does not effectively prolong the life of the battery. If one assumes that the first informing pattern includes an alerting duration of 0.5 seconds and an alerting halt duration of 0.5 seconds, and the second informing pattern includes an alerting duration of 0.2 seconds and an alerting halt duration of 0.8 seconds, the alerting time during one minute is still a high value of 12 seconds in the second informing pattern. Accordingly, the battery saving effect is only about ½. As in the above, for this receiver, the more one tries to prevent the reduction in battery life due to the second informing pattern, the more difficult it becomes for the user to recognize the informing operation. Therefore, a significant improvement of the battery life cannot be expected.

SUMMARY OF THE INVENTION

It is therefore an object of the present invention to provide a call informing device capable of prolonging battery life.

It is a further object of the present invention to provide a call informing device capable of prolonging battery life without changing the alerting pattern.

According to the present invention, the inventive call informing device includes an informing circuit which executes an informing operation during a first period of time when an address of a receiver is detected, a call reminder circuit which resumes the informing operation after passage of a second period of time from halting the informing operation, and a time setting circuit which controls the second period of time corresponding to the number of times the informing operation is repeated.

BRIEF DESCRIPTION OF THE DRAWINGS

The above and other objects, features and advantages of this invention will become more apparent from the following detailed description taken with the accompanying drawings in which.

DESCRIPTION OF THE PREFERRED EMBODIMENT

The preferred embodiments of the present invention will be described in detail with reference to FIGS. 1 to 7.

Figure 1:
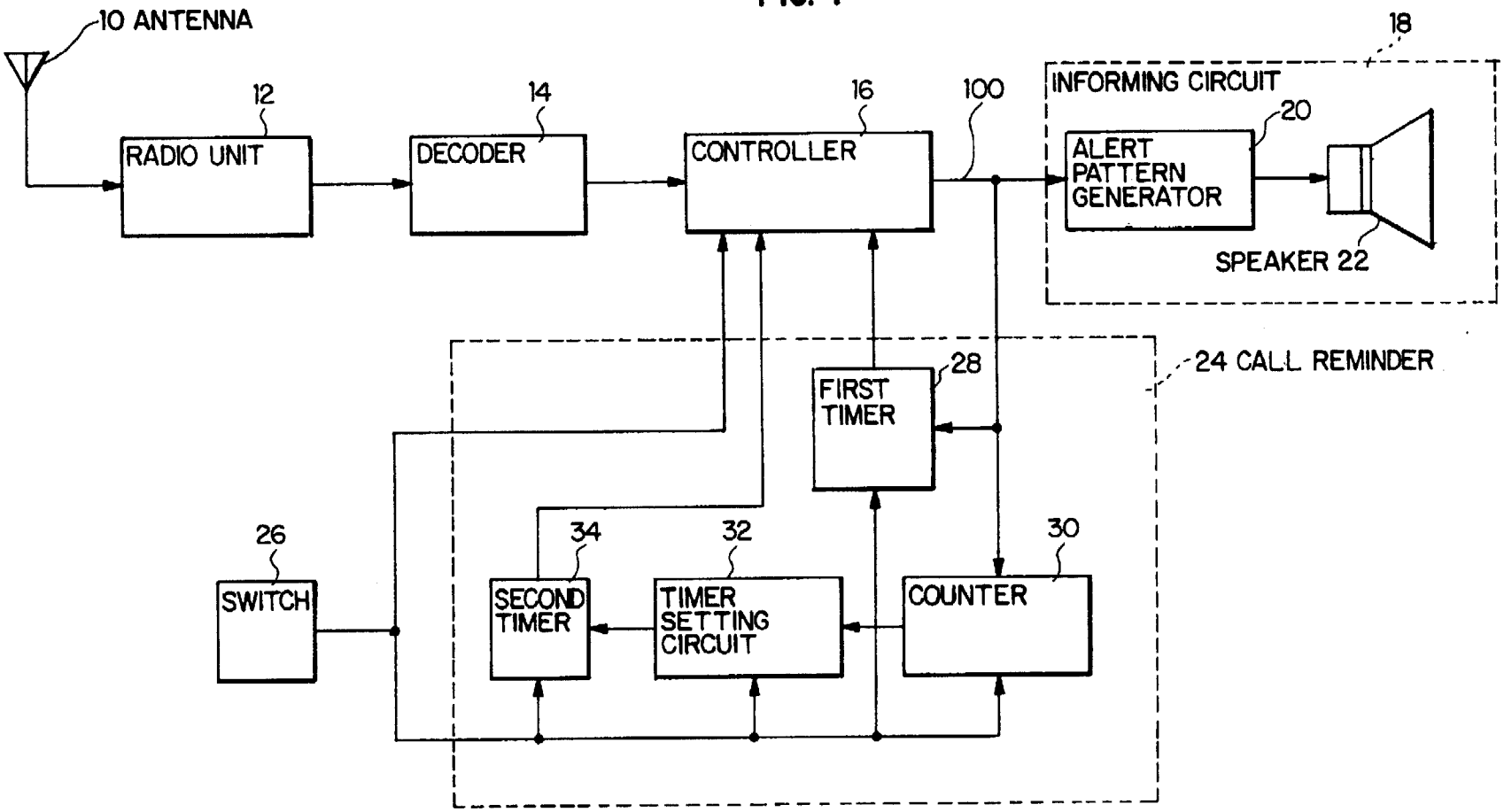
FIG. 1 is a block diagram of a preferred embodiment of a receiver using a call informing device according to the present invention.

FIG. 1 is a block diagram schematically showing a preferred embodiment of a receiver embodying the present invention. In FIG. 1, the receiver includes an antenna 10, a radio unit 12, a decoder 14, a controller 16, an informing circuit 18, a call reminder circuit 24 and a switch 26. The informing circuit 18 includes an alerting pattern generator 20 and a speaker 22. The call reminder circuit 24 includes a first timer 28, a second timer 34, a counter 30 and a timer setting circuit 32.

The radio unit 12 detects a signal received by the antenna 10. The detected signal is fed to the decoder 14. The decoder 14 detects an identification number or an address in the detected signal and sends a coincidence signal to the controller 16 when the identification number is identical with a pre-assigned identification number. Upon receipt of the coincidence signal, the controller 16 changes a level of a signal line 100 from "low" to "high" so as to activate the informing circuit 18. As the signal line 100 goes to a "high" level, the alerting pattern generator 20 generates an alerting pattern, and an alerting sound is output from the speaker 22 for a first predetermined time period t. When the signal line 100 goes to a "high" level, the call reminder circuit 24 is set by the controller 16. If the switch 26 is depressed within the time period t, the call reminder circuit 24 is reset, the controller 16 changes the level of the signal line 100 from "high" to "low" and the output of the alerting sound is terminated. If the switch 26 is not depressed within the time period t, the controller 26 and the call reminder circuit 24 repeatedly halt the output of alerting sound and perform a re-informing operation as described below.

The operation of the embodiment illustrated in FIG. 1 will be described with reference to FIGS. 2(*a*), 2(*b*) and 3.

Figures 2A, 2B:
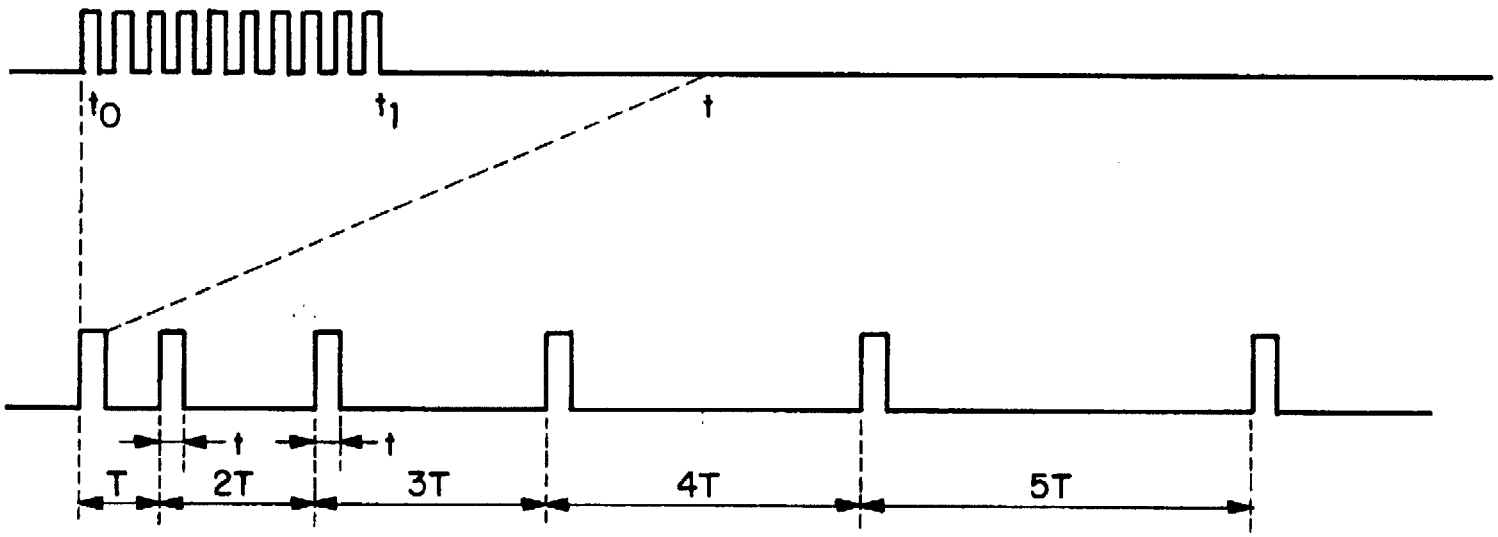
FIGS. 2(*a*) and 2(*b*) illustrate a timing chart showing an informing pattern according to the preferred embodiment of the present invention shown in FIG. 1.
Figure 3:
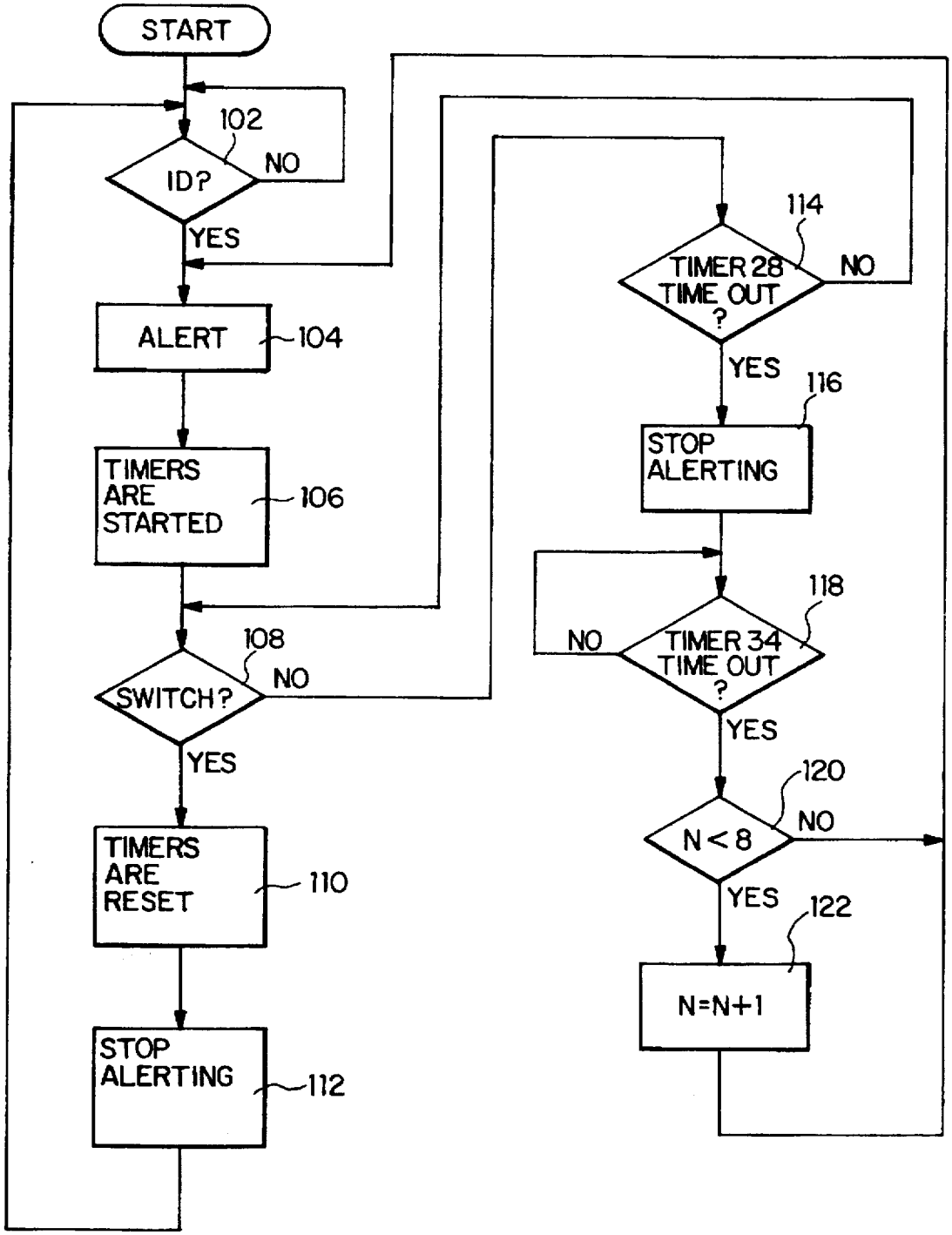
FIG. 3 is a flow chart showing a preferred control of a controller shown in FIG. 1.

When the pre-assigned identification number (ID) is detected in step 102, the controller 16 operates the informing circuit 18 to initiate an informing operation at time $t_0$ shown in FIG. 2(*a*) at step 104. In addition, the first timer 28 measures an elapsed time from initiation of the informing operation in step 106, and the counted value in the counter 30 becomes 1. The counter 30 sends the counted value to the timer setting circuit 32. The timer setting circuit 32 stores in advance a set value corresponding to the counted value, and sends the set value corresponding to the counted value to the second timer 34. In response, the second timer 34 starts to count time in step 106.

If the user notices the alerting sound during the informing operation of the receiver and the switch 26 is depressed in step 108 at time $t_1$ shown in FIG. 2(*a*), the first timer 28, the counter 30, the timer setting circuit 32, and the second timer 34 are reset in step 110. In addition, the controller 16 changes the level of the signal line 100 from "high" to "low" upon receipt from the signal of the switch 26. As a result, the operation of the alerting pattern generator 20 and the speaker 22 is terminated in step 112.

In the following description, assume that the switch 26 is not depressed in step 108.

A first predetermined time period t is set in the first timer 28. The time period t of the first timer 28 is set to a time which is easy for the user to recognize, and it is chosen to be, preferably, 20 seconds in this embodiment. While the first predetermined time period t elapses from the time $t_0$, the first timer 28 counts up to the time t, and sends a signal to the controller 16. In other words, the controller 16 changes the level of the signal line 100 from "high" to "low" when the signal from the first timer 28 is received at a time t=20 sec. after the start of the informing operation in step 114. As a result, the alerting pattern generator 20 is de-energized to stop the informing operation of the speaker 22 in step 116.

A set value T of the timer setting circuit 32 is set to an appropriate value by considering battery saving of the receiver and the convenience of the user. In the timer setting circuit 32 of this embodiment, the set value is chosen to be, preferably, 1 minute for a counted value of 1 in the counter 30, 2 minutes for a counted value of 2 in the counter 30, and so forth.

The second timer 34 continues to count time, and completes the set time after a time T=1 min. from the start of the informing operation, namely, 40 seconds after the halt of the informing operation, and sends a signal to the controller 16 in step 108. In response, the controller 16 drives the alert pattern generator 20 by changing the level of the signal line 100 from "low" to "high", and executes a re-informing operation by outputting the alerting sound in step 104. At this time, the first timer 28 resumes the time counting operation by the change of the signal line 101 from "low" to "high" in step 106. In addition, the counter 30 brings the counted value to 2 by incrementing the present value by one in step 122, when the number of the call re-informing operation is less than 8, as determined in step 120. The counter 30 sends the counted value of 2 to the timer setting circuit 32. Upon receipt of the counted value 2, the timer setting circuit 32 lets the second timer 34 start time counting by setting a time 2T=2 min. to the second timer 34 in step 106. In this embodiment, a value of eight re-informing operations is set in the timer setting circuit 32.

After a time t=20 sec. from the start of the second informing operation (T+t), the first timer 28 sends a signal to the controller 16, and the controller 16 causes the informing operation to be halted in Steps 114 and 116. Then, after a time of 2T=2 min. from the start of the second timer 34 as determined in step 118, the second timer 34 sends a signal to the controller 16 to start a third re-informing operation. Thereafter, the receiver continues to repeatedly perform a re-informing operation in a similar manner by incrementing the time interval between the re-informing operation by a time T, until the switch 26 is depressed by the user. In other words, this receiver has a re-informing interval of T minutes (T being a positive integer) in the (T+1)th informing operation (N=T). In this embodiment, if the number N of the call informing operations is equal to or greater than 8, the re-informing interval is 8T.

Figure 4:
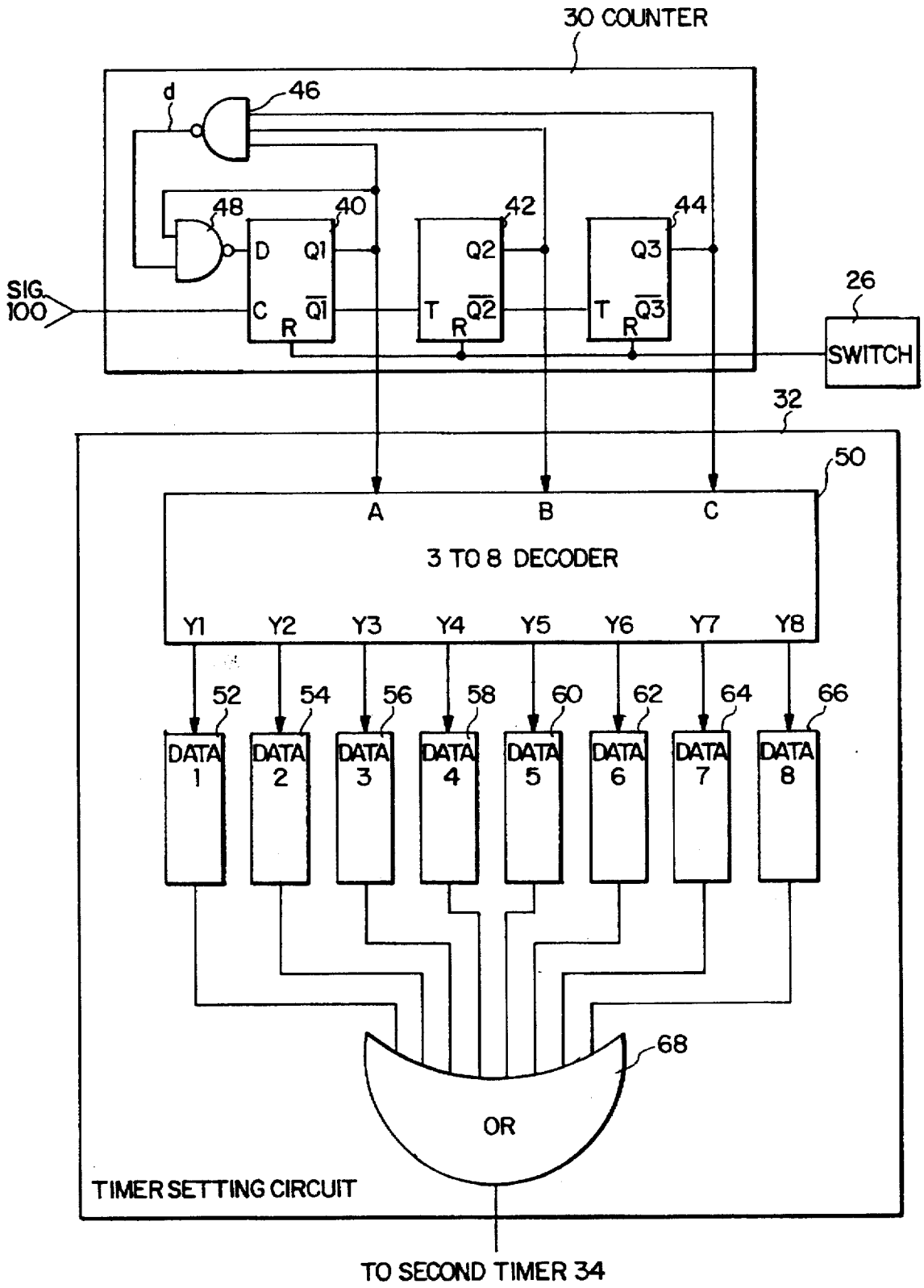
FIG. 4 is a block diagram of a preferred embodiment of the counter and timer setting circuit shown in FIG. 1.

FIG. 4 shows a preferred embodiment of the counter 30 and the timer setting circuit 32 shown in FIG. 1. In FIG. 4, the counter 30 includes flip-flops 40, 42 and 44 and NAND gates 46 and 48. The timer setting circuit 34 includes a decoder 50, memories 52, 54, 56, 58, 60, 62, 64 and 66 and OR gate 68.

Figures 5A, 5B, 5C, 5D, 5E, 5F, 5G:
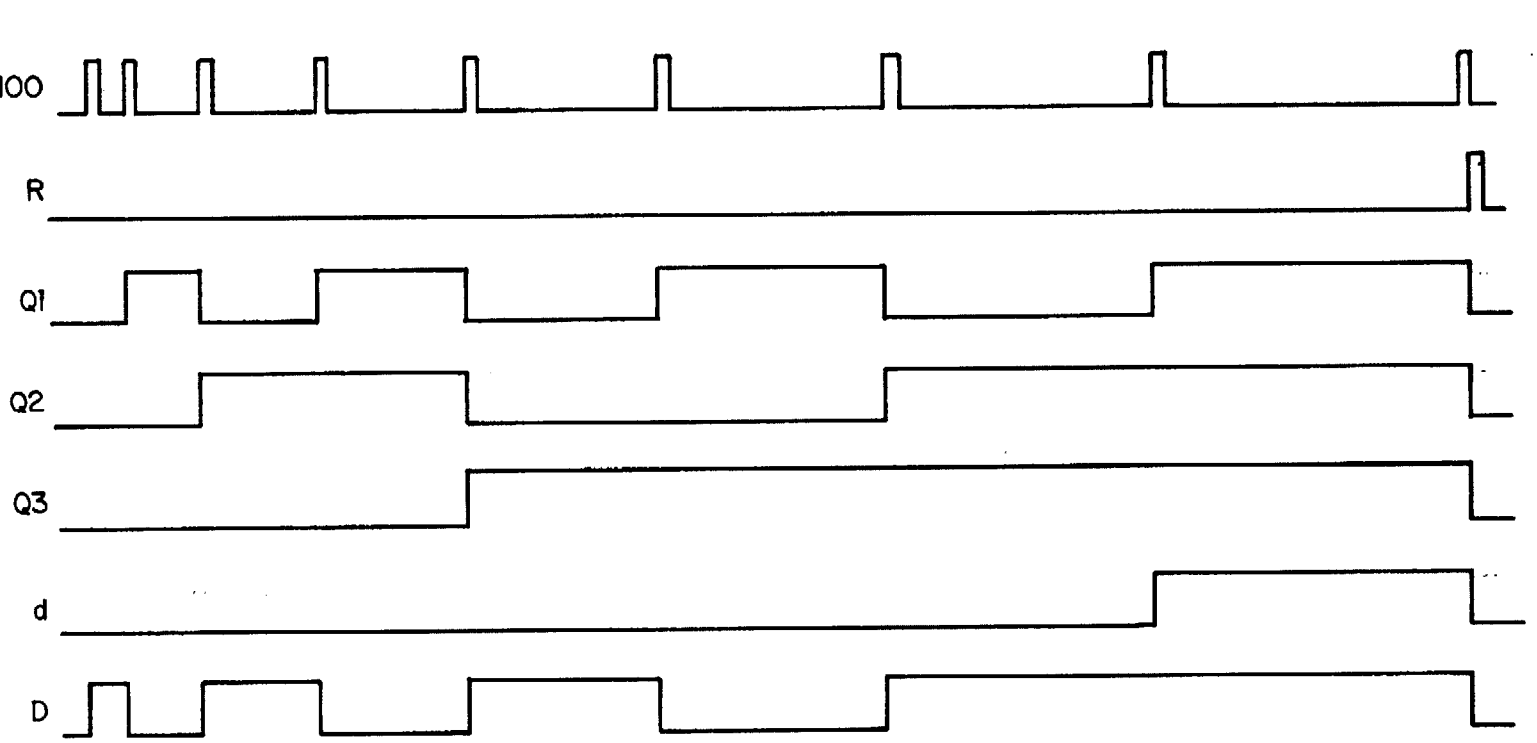
FIGS. 5(*a*) to 5(*g*) illustrate a timing chart covering various parts of the counter shown in FIG. 4.

The counter 30 counts the signal 100 and outputs Q1, Q2 and Q3 from the flip-flops 40, 42 and 44, respectively, in response to the number of the "high" level transitions of the signal line 100. When the switch 26 is depressed, the flip-flops 40, 42, and 44 are reset. The signal line 100, the outputs Q1, Q2, and Q3, the output d of the NAND gate 46 and the output D of the NAND gate 48 are shown in FIGS. 5(*a*), 5(*b*), 5(*c*), 5(*d*), 5(*e*), 5(*f*) and 5(*g*), respectively.

The decoder 50 receives the signal Q1, Q2 and Q3. In response to the output of the decoder 50, data is supplied to the OR gate 68 from one of the memories.

Figure 6:
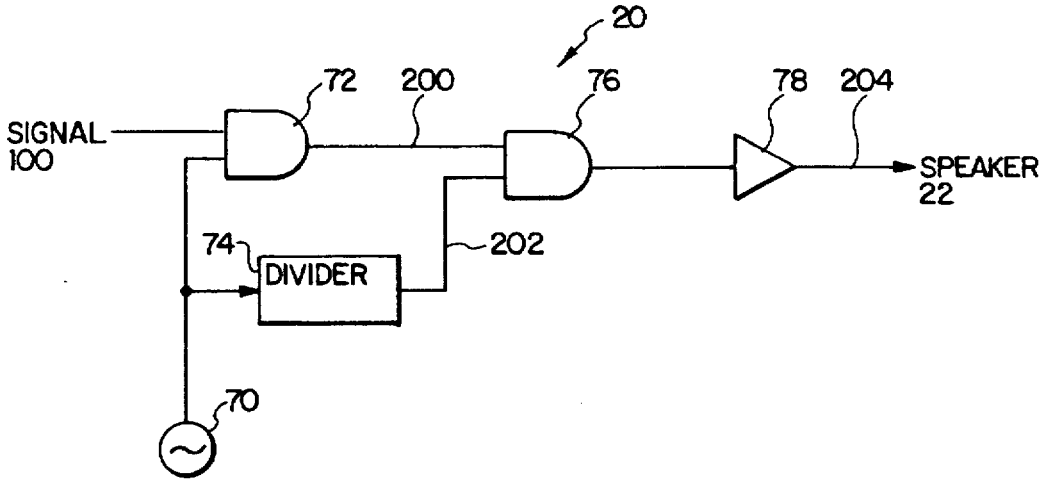
FIG. 6 is a block diagram of a preferred embodiment of the alerting pattern generator shown in FIG. 1.
Figure 7A:
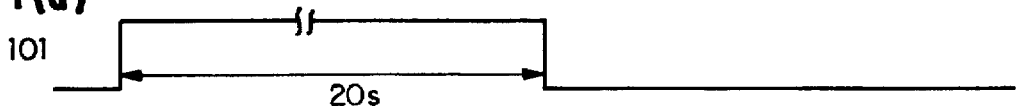
FIGS. 7(*a*) to 7(*d*) illustrate a timing chart covering various parts of the alerting pattern generator shown in FIG. 6. In the drawings, the same reference numerals denote the same structural elements.
Figure 7B:
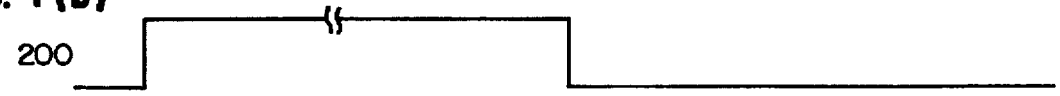
Figure 7C:
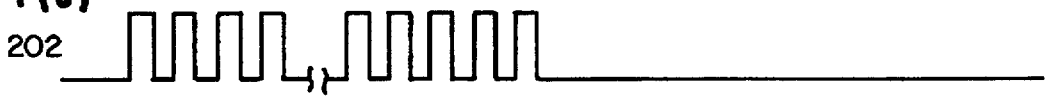
Figure 7D:
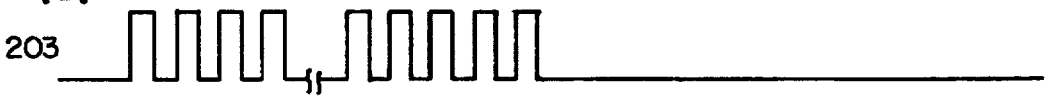

FIG. 6 shows a preferred embodiment of the alert pattern generator 20 shown in FIG. 1. The alert pattern generator 20 includes a synthesizer 70, AND gates 72 and 76, a divider 74 and a buffer 78.

The synthesizer 70 generates a signal having a frequency of 2.048 kHz. The AND gate 72 inputs the signal from signal line 100 shown in FIG. 7(*a*) and the output of the synthesizer 70 and outputs a signal 200 shown in FIG. 7(*b*). The divider 74 divides the output of the synthesizer 70 by 1024 and outputs a signal 202 shown in FIG. 7(*c*). The output 204 shown in FIG. 7(*d*) of the AND gate 76, which receives as inputs the signals 200 and 202 is supplied to the speaker 22 through the buffer 78.

Although the embodiment has been described with respect to a case in which the modification was based on a specific factor, it goes without saying that the present invention is not restricted to this case.

In the above embodiment, the device has a re-informing interval of N minutes in the (N+1) th informing operation. However, the remind interval may be $T^N$ in the (N+1) th informing operation.

Moreover, the device may repeat 8 values as the interval when the number of the informing operations surpasses 8. The value of the number may not 8. In addition, the value of the interval is selected freely so as to prolong the life of the battery.

Furthermore, as the informing circuit, a vibrator or a light may be used.

As stated above, in accordance with the present invention, the time interval between the informing operation is incremented in response to the increase in the number of times the informing operation. Therefore, the receiver according to the present invention has the effect that the re-informing performed immediately after the reception of the call signal, which requires as quick an action as is possible, can be executed at an extremely short interval. Furthermore, the re-informing operation at a time considerably after the reception of the call signal can be executed in a manner which suppresses the reduction of the battery life to a minimum level and the re-informing operation can be continued without change of the alerting pattern.

What is claimed is:

1. A call informing device for a radio receiver comprising:

an informing circuit for performing an informing operation for informing a user of a call when an address included in a received radio signal corresponds to a pre-assigned call number of said radio receiver comprising said call informing device;

a call reminder circuit for resuming said informing operation after a first period of time has elapsed from a halt in said informing operation and repeating said informing operation at a predetermined interval; and a controller for increasing said predetermined interval in accordance with a number of times an informing operation is performed.

2. A call informing device for a radio receiver comprising:

informing means for informing a user of a call during a first period of time when an address included in a received radio signal corresponds to a pre-assigned call number of said radio receiver comprising said call informing device;

call reminding means for resuming said informing operation at a predetermined interval after a second period of time has elapsed from a beginning of said informing operation, said second period of time being longer than said first period of time; and controlling means for increasing said predetermined interval in proportion to number of times said informing operation by said call reminding means is preformed.

3. The call informing device as claimed in claim 2, wherein said call reminding means comprises:

first measuring means for measuring said first period of time from said beginning of said informing operation;

a counter, coupled to said first measuring means and said controller, for counting said number of times said informing operation is performed;

setting means, coupled to said counter, for setting said second period of time proportional to an output from said counter; and second measuring means, coupled to said setting means and said controller, for measuring said second period of time.

4. The call informing device as claimed in claim 2, wherein said informing circuit comprises:

an alerting pattern generator for generating an audible alert pattern; and a speaker for outputting said audible alert pattern generated by said alerting pattern generator.

5. The call informing device as claimed in claim 3, wherein said setting means stores eight values for said second period of time.

6. The call informing device as claimed in claim 5, wherein an eighth value for said second period of time is selected when said output from said counter is greater than seven.

7. A pager having a call informing device comprising:

a detector for detecting an address of said pager in a received signal;

informing means for performing at least one informing operation for a predetermined time period for informing a user of an incoming call; and a controller, coupled to said informing means, for controlling an interval between sequential informing operations, said interval being increased in accordance with a number of said informing operations performed by said informing means.

8. The pager as claimed in claim 7, wherein said informing means comprises an audible alerting generator.

9. A call informing device comprising:

informing means for performing at least one informing operation for a predetermined time period for informing a user of an incoming call; and a controller, coupled to said informing means, for controlling an interval between sequential informing operations, said interval being increased in accordance with a number of said informing operations performed by said informing means.

10. The call informing device as claimed in claim 9, wherein said informing means comprises an audible alerting generator.

11. A method for controlling a call informing operation of a call informing device, said method comprising the steps of:

informing a user of an incoming call for a first predetermined period of time when an address included in a received signal corresponds to a pre-assigned call number of said call informing device;

reminding the user of said incoming call by performing an informing operation for said first predetermined period of time when a second time period has elapsed after said first period of time and repeating said informing operation at said second time period interval; and increasing a duration of said second time period interval in accordance with a number of times said informing operation is performed.

12. The method as claimed in claim 11, wherein said informing step is executed by audibly alerting the user of said incoming call.

13. A method for controlling a call informing operation of a call informing device, said method comprising the steps of:

performing at least one informing operation for a predetermined period of time to inform a user of an incoming call;

determining a number of informing operations performed; and controlling an interruption interval between sequential informing operations, wherein said interruption interval is increased in said controlling step in accordance with said number of said informing operations determined in said determining step.

* * * * *